US005509840A

United States Patent [19]

Huang et al.

[11] Patent Number: 5,509,840

[45] Date of Patent: Apr. 23, 1996

[54] FABRICATION OF HIGH ASPECT RATIO SPACERS FOR FIELD EMISSION DISPLAY

[75] Inventors: Jammy C. Huang, Taipei; David N. Liu, Hsinchu, both of Taiwan

[73] Assignee: Industrial Technology Research Institute, Hsinchu, Taiwan

[21] Appl. No.: 345,942

[22] Filed: Nov. 28, 1994

[51] Int. Cl.[6] ..... H01J 9/24

[52] U.S. Cl. ..... 445/24; 216/39; 216/40

[58] Field of Search ..... 445/24; 216/39, 216/40

[56] References Cited

U.S. PATENT DOCUMENTS

| | | | |
|---|---|---|---|
| 4,923,421 | 5/1990 | Brodie et al. | 445/24 |
| 5,063,327 | 11/1991 | Brodie et al. | 313/482 |
| 5,151,061 | 9/1992 | Sandhu | 445/24 |
| 5,205,770 | 4/1993 | Lowrey et al. | 445/24 |
| 5,232,549 | 8/1993 | Cathey et al. | 456/633 |

FOREIGN PATENT DOCUMENTS

| | | | |
|---|---|---|---|
| 6-139922 | 5/1994 | Japan | 445/24 |

*Primary Examiner*—P. Austin Bradley
*Assistant Examiner*—Jeffrey T. Knapp
*Attorney, Agent, or Firm*—George O. Saile; Stephen B. Ackerman

[57] ABSTRACT

A method for fabricating high aspect ratio spacers for a field emission display is described. An array of field emission microtips is formed over a substrate. A layer of lithographic material is formed over the array of field emission microtips. Openings are formed in the layer of lithographic material. The openings may be formed by a plasma etch with oxygen, or by x-ray lithography. A non-outgassing material is formed over the surface of the layer of lithographic material, including in the openings. The openings are filled with a spacer material, the spacer material being a conductive material, an insulator, or, preferably, a combination thereof. Lastly, the layer of lithographic material and the non-outgassing material are removed.

33 Claims, 6 Drawing Sheets

FABRICATION OF HIGH ASPECT RATIO SPACERS FOR FIELD EMISSION DISPLAY

BACKGROUND OF THE INVENTION (1) Field of the Invention

The invention relates to field emission flat panel displays, and more particularly to methods for fabricating high aspect ratio spacers for such displays.

(2) Description of the Related Art

In display technology, there is an increasing need for flat, thin, lightweight displays to replace the traditional cathode ray tube (CRT) device. One of several technologies that provide this capability is field emission displays (FED). An array of very small, conical emitters is manufactured, typically on a semiconductor substrate as part of a base plate, and is addressed via a matrix of columns and rows of conductive lines connected to peripheral addressing logic circuits. The emitters are formed on a conductive cathode, and surrounded by another conductive layer typically called the gate. When proper voltages are applied to the cathode and gate, electrons are emitted and attracted to an anode which is placed on a face plate opposite to the base plate. A pattern of cathodoluminescent material on the anode emits light when excited by the emitted electrons, providing the display element.

The base and face plates are mounted in very close proximity, in order to form a thin display and to maintain a high display resolution. A vacuum is formed in the area between the two plates, typically less than $10^{-6}$ torr. It is important to maintain a uniform spacing between the opposing plates in order to provide consistent resolution across the display surface. In order to maintain this uniform spacing in the presence of the vacuum, spacers are typically placed between the opposing plates. Except for displays with a very small surface area, e.g., on the order of a few square inches or less, these spacers are required, in order to maintain consistent spacing in light of the large pressure differential between the outside of the face plate and the evacuated region.

Other requirements of spacers for a field emission display include a small cross-sectional area and proper registration. The spacers must be small enough in cross-section to prevent being visible to a viewer of the display, so a high aspect ratio is necessary. The process for forming the spacers, and integrating them with the display face and base plates, should provide a simple means for aligning the emitting surface with the opposing face plate.

Workers in the field are aware of these problems and have attempted to solve them. In U.S. Pat. No. 4,923,421, Brodie et al. disclose a method of forming spacers using polyimide resins as the spacer material, and standard photolithographic techniques to form the spacers. However, the use of polyimide can cause problems due to outgassing, i.e., the release of volatile components, with the problems including poor electron emission and short emitter life.

In U.S. Pat. No. 5,232,549 (Cathey et al), after forming a polymer material from which the spacers will be formed, and a thin patterned reflective layer above the polymer, a laser is used to ablate away material after which the spacers remain. Alternately, a laser is used to form holes in an etchable layer, and the holes are filled with a spacer material, after which the etchable material is removed.

U.S. Pat. No. 5,205,770 (Lowrey et al) discloses a similar process in which a micro-saw is used to form grooves in a substrate, the grooves are filled with a spacer material, chemical mechanical polishing is performed on both ends of the spacers, and the mold is removed. A drawback with this technique is the requirement of an additional frit seal to connect the spacers with both the baseplate and faceplate.

None of the preceding methods, however, address the problem of alleviating charge build-up on the spacers. During display operation, electric charge may accumulate on the spacers, and if not discharged in a controlled means result in disturbance of the screen image.

SUMMARY OF THE INVENTION

It is therefore an object of this invention is to provide a very manufacturable method for fabricating high aspect ratio spacers for a field emission display.

It is a further object of this invention to provide a very manufacturable method for fabricating high aspect ratio spacers for a field emission display that do not result in outgassing.

Another object of this invention is to provide a very manufacturable method for fabricating high aspect ratio spacers consisting of conductive and insulative sections, in which the conductive sections are not left at a floating voltage, so as to prevent charge build-up on the spacers, and to provide electron beam focusing. The insulative sections provide the necessary insulation between the two electrodes of the display.

These objects are achieved by first forming an array of field emission microtips over a substrate. A layer of lithographic material is formed over the array of field emission microtips. Openings are formed in the layer of lithographic material. A non-outgassing material is formed over the surface of the layer of lithographic material, including in the openings. The openings are filled with a spacer material. The layer of lithographic material and the non-outgassing material are removed.

The openings are formed in several ways. A metal layer is formed over the layer of lithographic material, and patterned to form a mask for the openings, at the desired spacer locations. An oxygen plasma etch is then used to form the spacer openings in the lithographic material. Hard x-ray lithography may also be used to create the high-aspect ratio spacer openings, as well as traditional optical lithography where low aspect ratio spacer openings are required.

The spacers themselves may be formed of one of two combinations of materials. The step of filling the openings may comprise partially filling the openings by electroplating with a conductive plating material, and then filling the remainder of the openings with a dielectric material. Or the openings may be filled and the layer of lithographic material covered by a dielectric paste, and the dielectric paste over the layer of lithographic material removed by chemical mechanical polishing.

DESCRIPTION OF THE PREFERRED EMBODIMENTS

Figure 1:
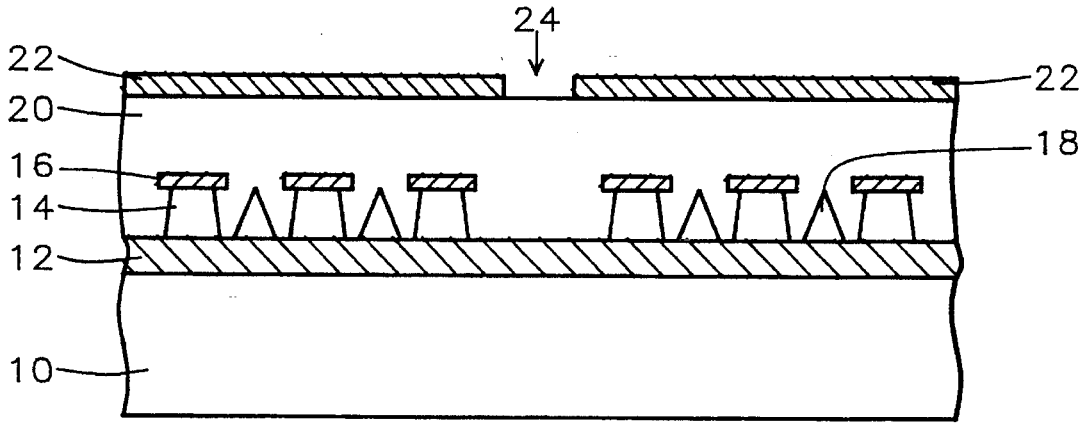
FIGS. 1 to 8 are cross-sectional representations of a first method of the invention for forming high aspect ratio spacers for a field emission display.

Referring now to FIGS. 1 to 8, a first method for forming the high aspect ratio spacers of the invention is described. FIG. 1 shows the emitters 18 already formed. A conductive layer 12, which can be a metal or polysilicon, is formed over a substrate 10. The formation of the emitters will not be described in detail, as it is well known in the art and is not important to the invention. An insulating layer 14 is formed to separate the emitters, and a conductive gate layer 16 is formed over the insulating layer. Openings are formed in both these layers at the desired emitter locations, and the conical emitters are formed in the openings. The emitters are formed of a conductive material such as molybdenum.

A layer 20 of polyimide, photoresist or other polymer is formed over the emitters to a thickness of between about 10 and 500 micrometers. The emitters may optionally be coated with a protective layer (not shown) such as silicon oxide, prior to deposition of layer 20. The thickness of layer 20 will determine the maximum height of the spacers to be formed and thus the distance between the back plate, from which field emission takes place, to the face plate, on which the anode and phosphors are formed.

Openings now are formed in layer 20 to form molds for the high aspect ratio spacers of the invention. One method for forming the required high aspect ratio openings is by a plasma etch with oxygen. A first metallic mask layer 22 is formed over layer 20, and then patterned to form openings 24 by conventional lithography and etching. The metal mask is formed of chromium, titanium, nickel or the like, to a thickness of between about 2000 and 5000 Angstroms, by evaporation or sputtering. The openings 24 are formed to a width of between about 10 and 100 micrometers, which determines the cross-sectional area of the spacers. This area must be kept small to prevent visual interference during display operation. The resulting height-to-width aspect ratio of the spacers is between about 1:1 and 50:1.

Figure 2:
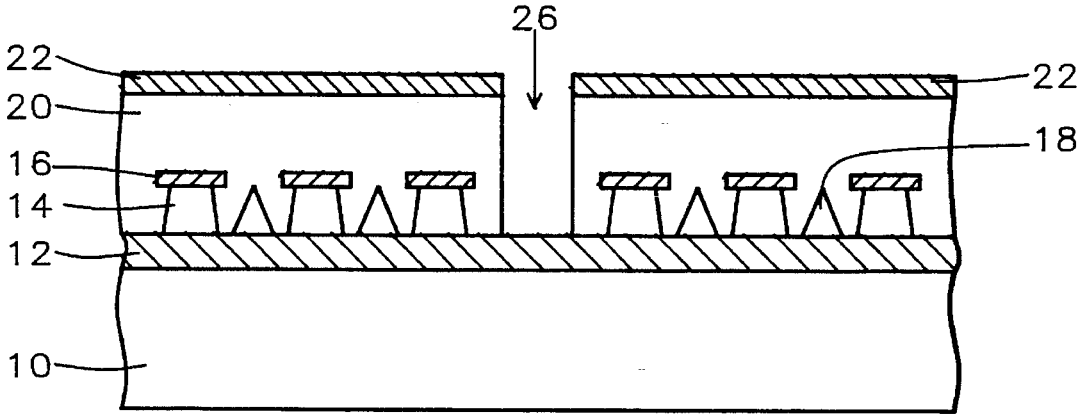

Referring now to FIG. 2, the mold openings 26 are formed by a plasma etch with oxygen ($O_2$). The $O_2$ plasma etches at a rate of more than about 3000 Angstroms/minute for poly methyl metacrylate (PMMA) at a power of about 50 watts. The location of the spacers will be described later in more detail, but they are typically formed between groups of emitters, as shown in FIG. 2, where each group of emitters forms a pixel for the field emission display. The metal mask layer 22 is removed by etching. For a Cr (chromium) metal mask, the etchant used would be 100 g. $K_3Fe(CN)_6$: 50 g. KOH: 1000 ml. $H_2O$, which etches Cr at a rate of about 300 Angstroms/minute.

Figure 3:
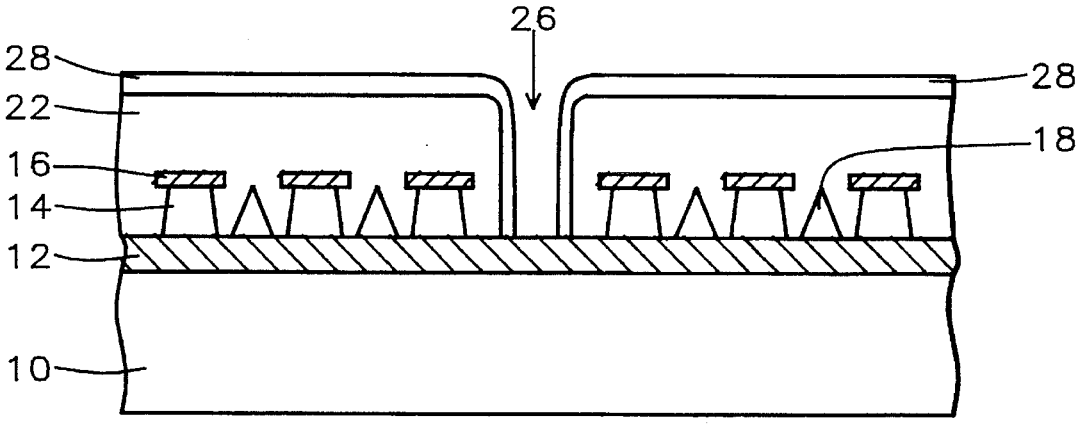

Referring now to FIG. 3, a critical step of the invention is shown, which is the formation of non-outgassing layer 28 over the surface of layer 22, including in the openings 26. This layer may be formed of materials such as $Al_2O_3$ (aluminum oxide), MgO (magnesium oxide), or $Si_3N_4$ (silicon nitride), to a thickness of between about 500 and 3000 Angstroms, by chemical vapor deposition or by electroless plating. After deposition of layer 28, a directional etch such as reactive ion etching is used to remove the layer 28 material from the bottom of opening 26. This layer is necessary to prevent the layer 22 material from sticking to the spacers that are to be subsequently formed. If the layer 28 non-outgassing layer was not present, layer 22 formed of an organic material would come in contact with the spacer material during spacer formation, and upon removal of the mold layer 22, leave organic residue on the spacers, resulting in outgassing problems.

Figure 4:
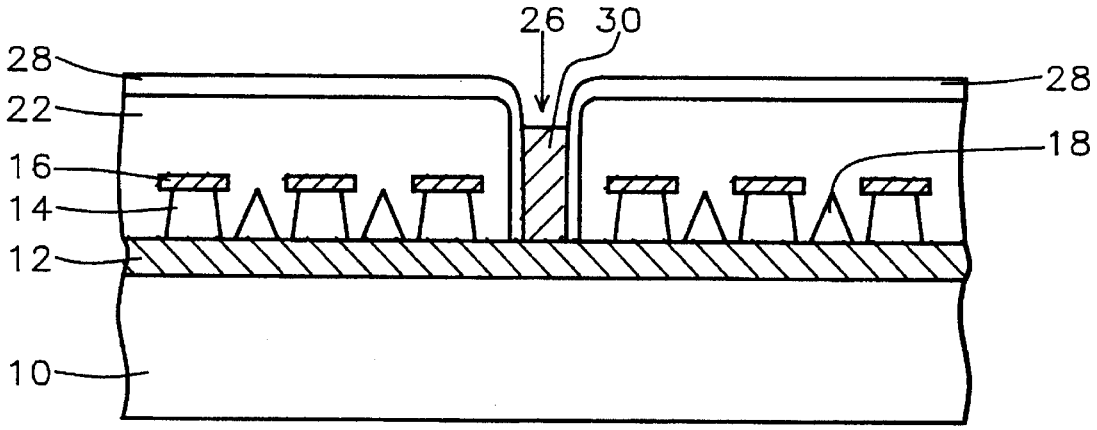

With reference to FIG. 4, a first method of forming the spacers 30 is shown. A plating material such as Au (gold), Ni (nickel) or Cu (copper) is formed in the opening 26 by electroplating, wherein metal is deposited onto a conductive surface from a solution by electrolysis. The opening 26 may be either partially filled, or completely filled and any material formed above the top of the opening removed by CMP (chemical mechanical polishing). CMP consists of holding and rotating a semiconductor wafer against a polishing surface, on which there is a polishing slurry containing abrasive material such as alumina or silica. At the same time, a chemical etchant may be introduced, so that material is removed from the wafer by both chemical and mechanical means. The endpoint is detected by various means, such as frictional differences between materials, or by capacitive measurements. Here, the endpoint is determined by frictional difference.

Figure 5:
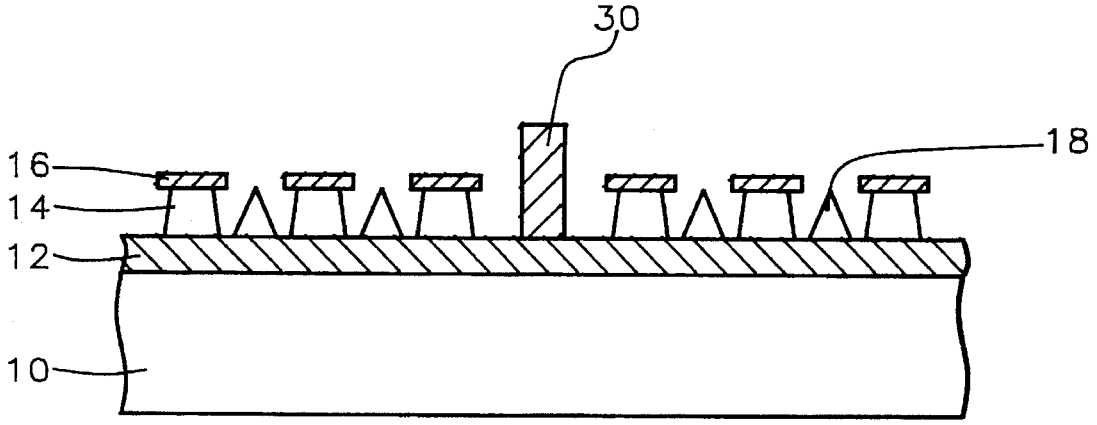

The resultant spacers 30 have a height of between about 10 and 500 micrometers. Where opening 26 is partially filled, CMP may also be used, after removal of layers 22 and 28, to obtain uniform spacer height. Layer 20 and non-outgassing layer 28 are now removed. For example, layer 28 is etched with $H_3PO_4$ (phosphoric acid) when it is formed of $Si_3N_4$, and layer 22 is etched with $H_2SO_4$ (sulfuric acid) and $H_2O_2$ (hydrogen peroxide) when it is formed of a photoresist. The resultant structure with spacers 30 is shown in FIG. 5.

Figure 6:
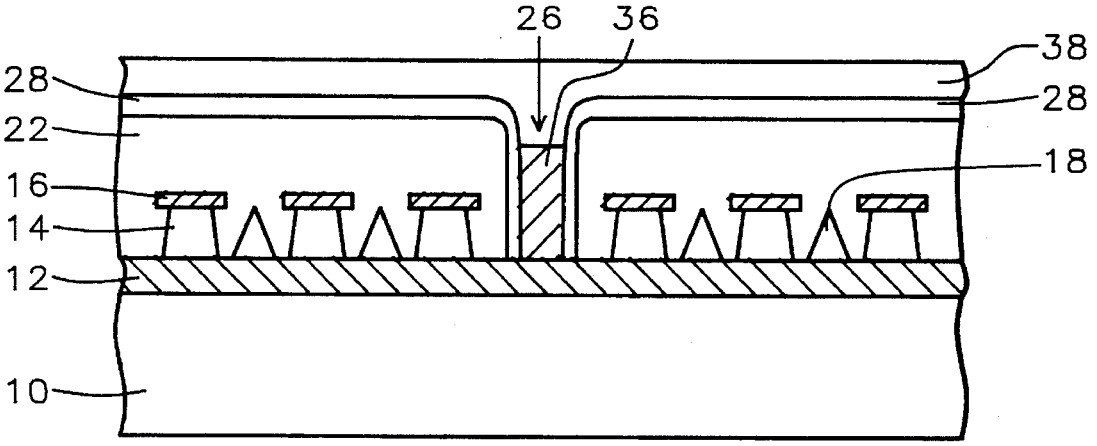
Figure 7:
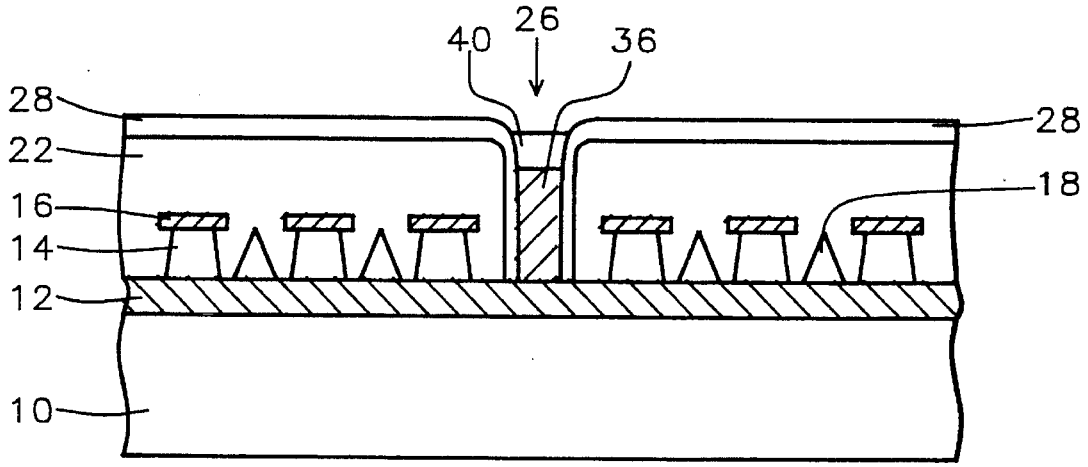
Figure 8:
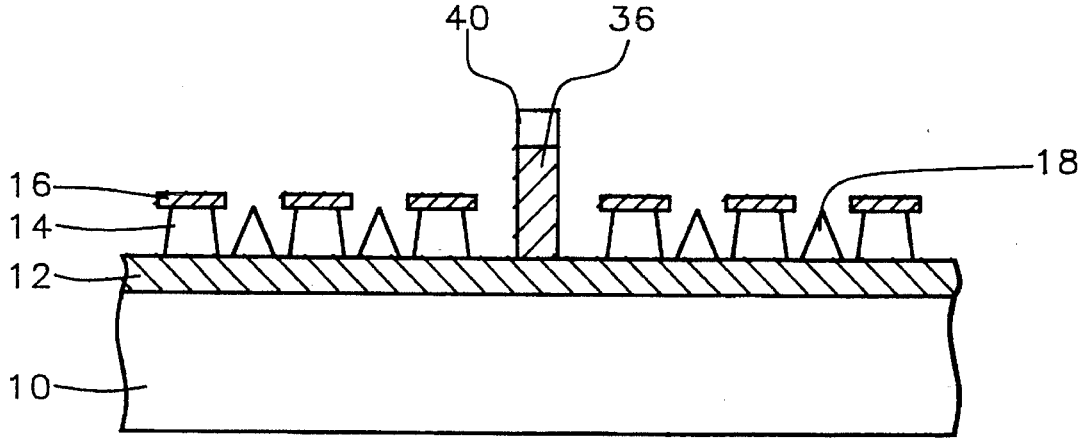

The spacers may alternately be formed of plated metal and a top layer dielectric, as shown in FIGS. 6 to 8. After partially filling the opening 26 with a plated metal 36 to a height of between about 5 and 250 micrometers, in the manner described above, a dielectric 38, such as glass paste, is deposited by casting. The dielectric may be formed to just fill the opening, or to fill the opening and overlie layer 22, with the thickness in opening 26 of between about 5 and 250 micrometers. When dielectric 38 is formed over the top of layer 22, it may be etched back by CMP. Layer 22 and non-outgassing layer 28 are then removed as earlier described, to result in the FIG. 8 structure.

Prior art spacers are formed of non-conductive material, such as polyimide. However, by using the metal spacers of FIGS. 5 and 8, several advantages may be gained. There is no outgassing problem as can occur with the use of polyimide, which can result in poor electron emission and short emitter life. Importantly, the conductive spacers may be kept at a bias voltage, through conductive layer 12 to which the spacers make contact, allowing a discharge path for accumulated charge on the spacers. Using the non-conductive spacer of the prior art can lead to charge accumulation during display operation, and subsequent discharge, leading to poor display image. The dielectric 40 serves as an insulator between the cathode and anode. A further advantage of the metal spacer is that it may act as a focussing ring, since when it is either grounded or has negative charge, emitted electrons will move toward the anode rather than toward the spacers.

Figure 9:
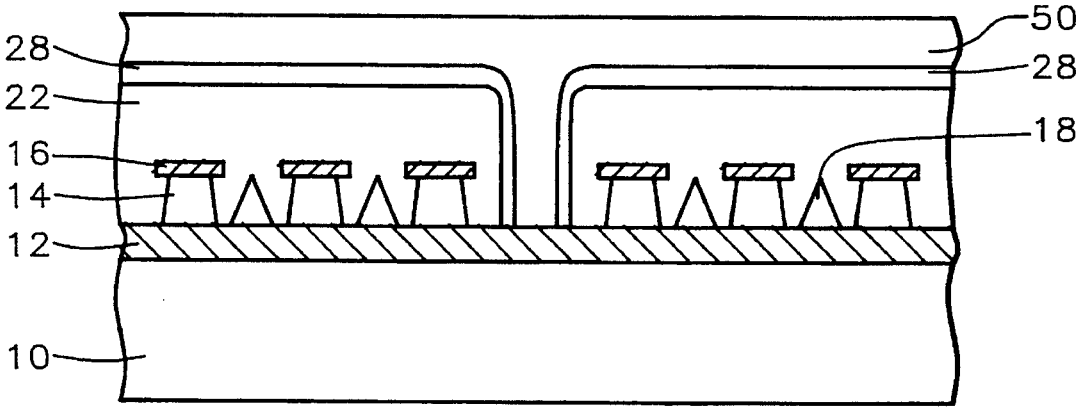
FIGS. 9 to 11 are a cross-sectional representation for a second method of the invention for forming high aspect ratio spacers for a field emission display.
Figure 10:
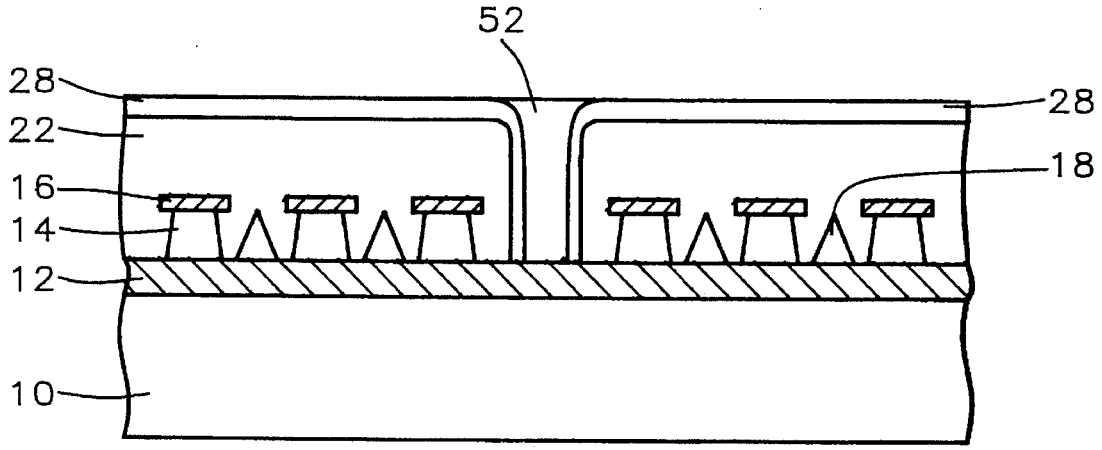
Figure 11:
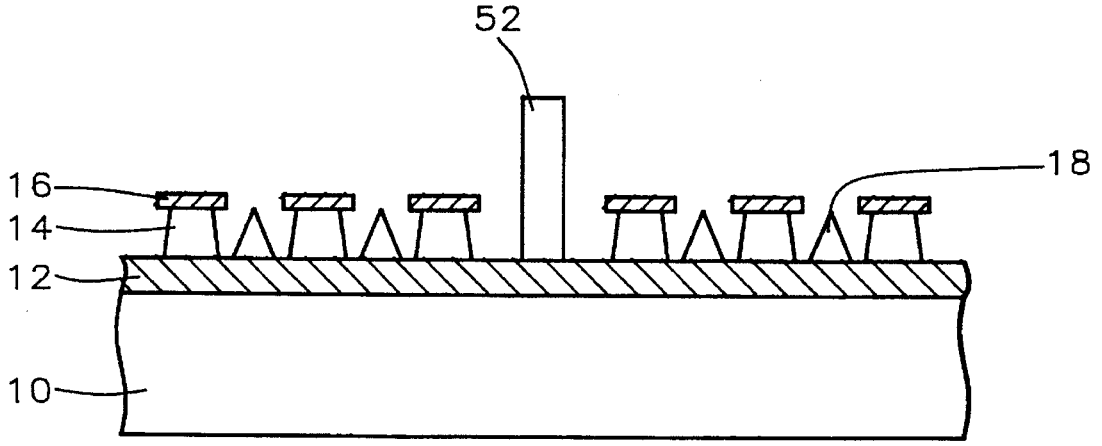

A second method of the invention is shown in FIGS. 9 to 11. After forming the FIG. 3 structure, a dielectric paste 50 of, for instance, $Al_2O_3$, $SiO_x$ (silicon oxide) or MgO, is deposited by casting. Curing is then performed, at a temperature of between about 500° and 1000° C., for between about 60 and 180 minutes. Layer 50 is then etched back to the height of the non-outgassing layer 28 by CMP.

Finally, the polyimide, photoresist or polymer layer 22, and the non-outgassing layer 28, are removed, to leave spacer 52, as shown in FIG. 11. The field emission display structure is completed, with respect to FIGS. 5, 8 and 11, by mounting a face plate (not shown) opposite and parallel to the base plate on which the spacers are formed. The face plate is typically formed of a transparent material on which a conductive anode and phosphors have been formed. The space between the back and face plates is evacuated to a pressure of about $10^{-6}$ torr.

Figure 12:
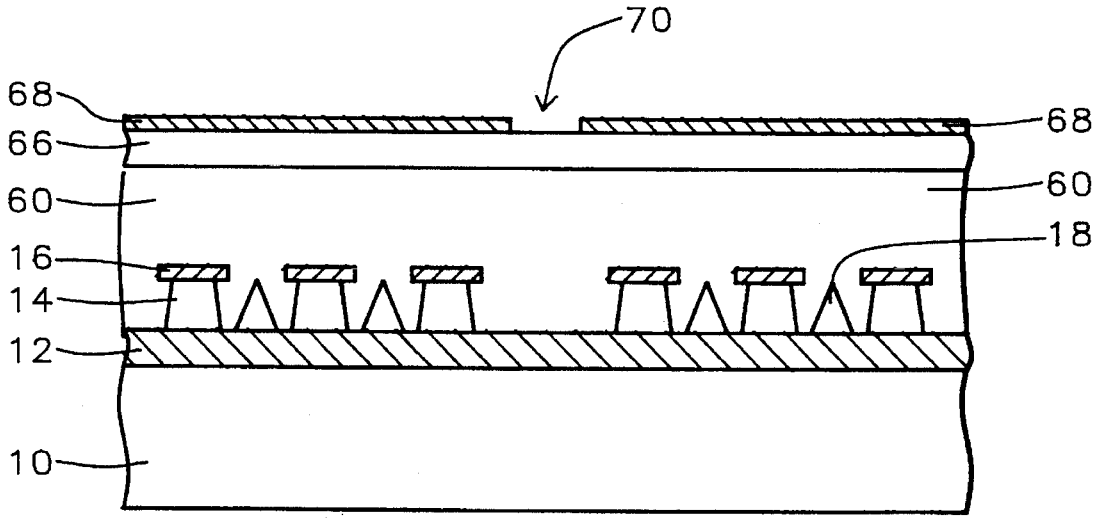
FIGS. 12 and 13 are a cross-sectional representation of an alternate method for forming openings for the high aspect ratio spacers of the invention.
Figure 13:
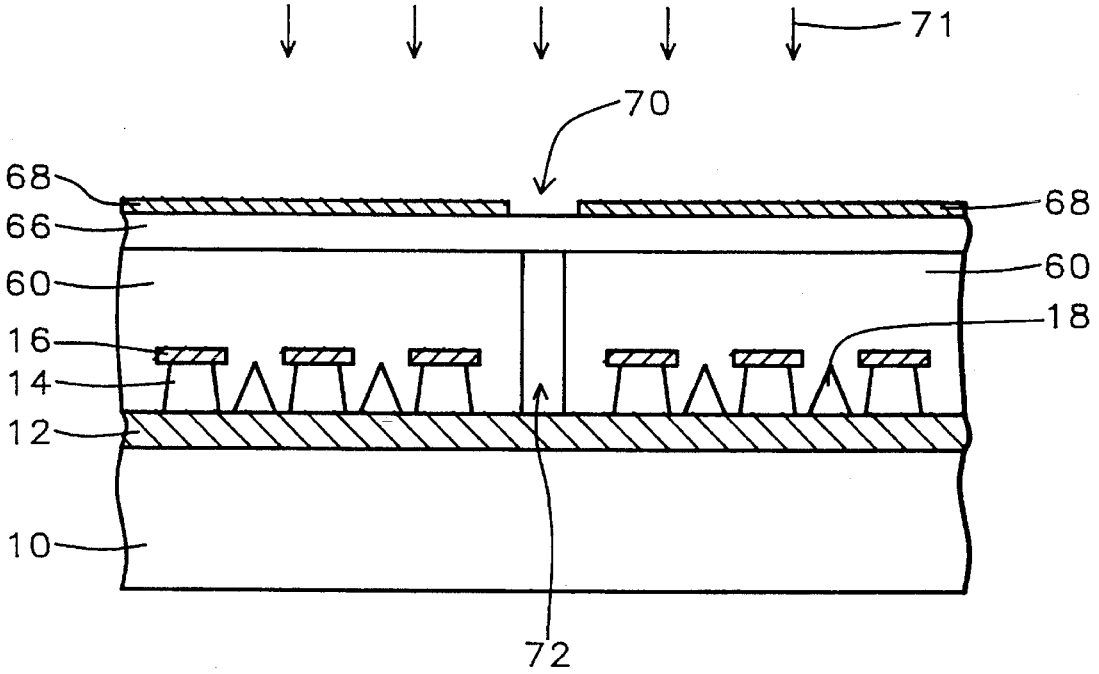

An alternate method of forming the mold openings for the spacers is illustrated in FIGS. 12 and 13, in which x-rays are used to create the spacer openings. After forming the emitters 18, a layer 60 of polymethyl methacralate (PMMA) is formed to a thickness of between about 10 and 500 micrometers, by casting. A mask membrane 66 is formed by using a thick beryllium foil having a thickness of about 400 micrometers. An absorber layer 68 of gold (Au) is deposited by printing to a thickness of between about 5 and 20 micrometers, and is patterned to form openings 70 above the desired spacer locations. X-rays 71 generated by synchrotron radiation at a dose of about 10 KJ/cm.$^3$ (kilo joule per cubic centimeter) are then used to form the mold 72, as shown in FIG. 13. Layers 66 and 68 are removed and the spacers then formed by the techniques described earlier.

Figure 14:
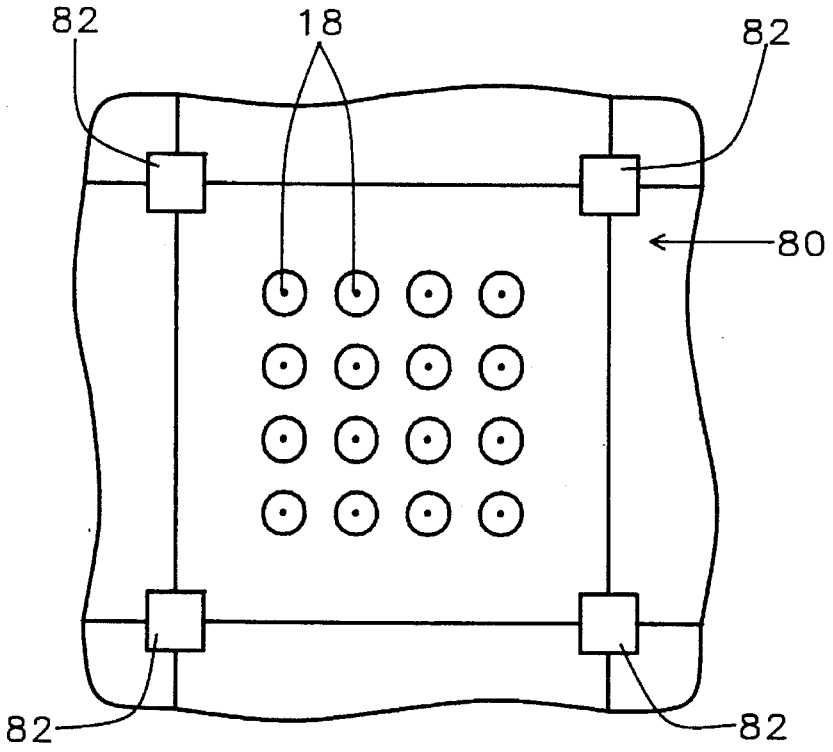
FIGS. 14 and 15 are a top view showing locations for formation of the high aspect ratio spacers of the invention, in relation to a pixel in a field emission display.
Figure 15:
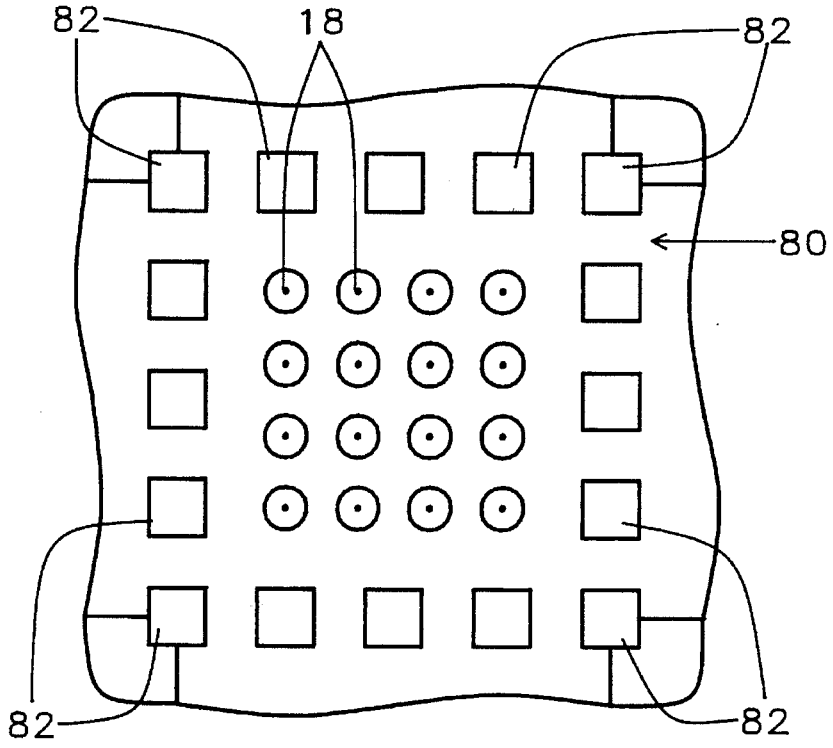

There are several alternatives for the spacer locations, as shown in the top views of FIGS. 14 and 15. The first alternative is to form spacers 82 at the corner of each pixel 80. Each pixel in a field emission display is usually formed of several emitters 18, as shown in FIG. 14, to provide redundant operation. The pixel size is about 250 micrometers by 250 micrometers. Alternately, the spacers could be formed at the corners of a group of pixels. Or, as shown in FIG. 15, the spacers are formed in a grid around each pixel, and may be used as a focusing ring, as earlier described. Note that especially in the FIG. 15 structure where many spacers are used around each pixel, that the spacer cross-sectional area must be kept small to prevent being visible to a user of the display. As noted earlier, each spacer may be composed of an insulator only, a conductive material only, or a combination of the two. When a conductor is used it is usually connected to a bias voltage.

While the invention has been particularly shown and described with reference to the preferred embodiments thereof, it will be understood by those skilled in the art that various changes in form and details may be made without departing from the spirit and scope of the invention. For example, the high aspect ratio spacers of the invention were formed on the baseplate of a field emission display, however the same methods as discussed above could be used to form the spacers instead on the faceplate of the display.

What is claimed is:

1. A method of fabricating a field emission display having high aspect ratio spacers, comprising the steps of:

forming an array of field emission microtips over a substrate;

forming a layer of lithographic material over said array of field emission microtips;

forming openings in said layer of lithographic material;

forming a layer of non-outgassing material over the surface of said layer of lithographic material, including in said openings;

filling said openings with a non-outgassing spacer material; and removing said layer of lithographic material and said layer of non-outgassing material.

2. The method of claim 1 wherein said layer of non-outgassing material is formed from a material taken from the group consisting of aluminum oxide, magnesium oxide and silicon nitride, to a thickness of between about 500 and 3000 Angstroms.

3. The method of claim 1 wherein said filling said openings with a non-outgassing spacer material further comprises the steps of:

partially filling said openings by electroplating with a plating material; and filling the remainder of said openings with a dielectric material.

4. The method of claim 1 wherein said filling said openings with a non-outgassing spacer material further comprises the steps of:

filling said openings and covering said layer of lithographic material with a dielectric paste; and removing the portion of said dielectric paste over said layer of lithographic material by chemical mechanical polishing.

5. The method of claim 1 wherein said lithographic material is formed to a thickness of between about 10 and 500 micrometers.

6. The method of claim 5 wherein said lithographic material is taken from the group consisting of polyimide, photoresist and polymer.

7. The method of claim 1 wherein said forming openings further comprises the steps of:

forming a conductive layer over said layer of lithographic material;

forming second openings in said conductive layer, at desired locations of said high aspect ratio spacers;

removing said lithographic material in regions defined by said second openings, by plasma etching with oxygen; and removing said conductive layer.

8. The method of claim 7 wherein said conductive layer is formed of chromium to a thickness of between about 2000 and 5000 Angstroms.

9. The method of claim 7 wherein said second openings are formed to a width of between about 10 and 100 micrometers.

10. The method of claim 1 wherein said forming openings further comprises the steps of:

forming a mask membrane over said layer of lithographic material;

forming and patterning an absorber layer over said mask membrane having a second opening at desired locations of said high aspect ratio spacers; and exposing said lithographic material to x-ray lithography to form said openings.

11. The method of claim 10 wherein said layer of lithographic material is polymethyl methacralate formed to a thickness of between about 10 and 500 micrometers, said mask membrane is formed of beryllium to a thickness of about 400 micrometers, and said absorber layer is formed of gold to a thickness of between about 5 and 20 micrometers.

12. The method of claim 11 wherein said second opening is formed to a width of between about 10 and 100 micrometers.

13. The method of claim 1 wherein said field emission microtips are formed in groups of one to many of said microtips, and wherein said groups form pixels for said field emission display.

14. The method of claim 13 wherein said high aspect ratio spacers are formed at the corners of said pixels.

15. The method of claim 14 wherein additional high aspect ratio spacers are formed between said high aspect ratio spacers formed at said corners of said pixels.

16. The method of claim 15 wherein said high aspect ratio spacers are formed at the corners of a group of said pixels.

17. A method of fabricating a field emission display having high aspect ratio spacers, comprising the steps of:

forming an array of field emission microtips over a substrate;

forming a layer of lithographic material over said array of field emission microtips;

forming openings in said layer of lithographic material;

forming a non-outgassing material over surface of said layer of lithographic material, including in said openings;

forming a layer of conductive spacer material in said openings; and removing said layer of lithographic material and said non-outgassing material.

18. The method of claim 17 wherein said lithographic material is formed to a thickness of between about 10 and 500 micrometers.

19. The method of claim 17 wherein said openings are formed to a width of between about 10 and 100 micrometers.

20. The method of claim 17 wherein said non-outgassing material is formed of aluminum oxide to a thickness of between about 500 and 3000 Angstroms.

21. The method of claim 17 further comprising the step of forming a conductive layer between said substrate and said array of field emission microtips, whereby said conductive spacer materials are formed in contact with said conductive layer.

22. The method of claim 21 wherein said conductive layer is set at a bias voltage during display operation.

23. The method of claim 17 wherein said forming a layer of conductive spacer material is by electroplating, to a thickness of between about 10 and 500 micrometers.

24. The method of claim 23 wherein said conductive spacer material is taken from the group consisting of gold, nickel and copper.

25. The method of claim 17 wherein said forming a layer of conductive spacer material only partially fills said openings, and further comprising the steps of:

completing the filling of said openings with a dielectric material and wherein said dielectric material is also formed over said lithographic layer; and removing said dielectric material from over said lithographic layer by chemical mechanical polishing.

26. The method of claim 25 wherein said conductive spacer material is formed to a thickness of between about 5 and 250 micrometers.

27. The method of claim 25 wherein said dielectric material is formed to a thickness of between about 5 and 250 micrometers.

28. A method of fabricating a field emission display having high aspect ratio spacers, comprising the steps of:

forming an array of field emission microtips over a substrate;

forming a layer of lithographic material over said array of field emission microtips;

forming openings in said layer of lithographic material;

forming a non-outgassing material over surface of said layer of lithographic material, including in said openings;

filling said openings and covering said layer of lithographic material with a dielectric paste;

removing said dielectric paste in the region over said layer of lithographic material, by chemical mechanical polishing; and removing said layer of lithographic material and said non-outgassing material.

29. The method of claim 28 wherein said lithographic material is formed to a thickness of between about 10 and 500 micrometers.

30. The method of claim 28 wherein said openings are formed to a width of between about 10 and 100 micrometers.

31. The method of claim 28 wherein said non-outgassing material is formed of aluminum oxide to a thickness of between about 500 and 3000 Angstroms.

32. The method of claim 28 wherein said dielectric paste is formed of a material taken from the group consisting of aluminum oxide, silicon oxide and magnesium oxide.

33. The method of claim 32 further comprising the step of curing said dielectric paste after said filling said openings, by heating to a temperature of between about 500° and 1000° C. for between about 60 and 180 minutes.

* * * * *